US006921232B2

(12) United States Patent
Domanski et al.

(10) Patent No.: US 6,921,232 B2
(45) Date of Patent: Jul. 26, 2005

(54) MINE ROOF-SUPPORT TRUSS

(75) Inventors: Lothar Domanski, Oberhausen (DE); Rudi Podjadtke, Herne (DE); Franz-Josef Wunderlich, Rheinberg (DE)

(73) Assignee: Bochumer Eisenhutte Heintzmann GmbH & Co. KG, Bochum (DE)

( * ) Notice: Subject to any disclaimer, the term of this patent is extended or adjusted under 35 U.S.C. 154(b) by 0 days.

(21) Appl. No.: 10/895,244

(22) Filed: Jul. 20, 2004

(65) Prior Publication Data

US 2005/0031420 A1 Feb. 10, 2005

(30) Foreign Application Priority Data

Aug. 7, 2003 (DE) ..... 103 36 154

(51) Int. Cl.[7] ..... E21D 23/00
(52) U.S. Cl. ..... 405/288; 405/302.1
(58) Field of Search ..... 405/288, 302.1–302.3, 405/259.1

(56) References Cited

U.S. PATENT DOCUMENTS 4,699,547 A * 10/1987 Seegmiller ..... 405/288
4,776,729 A * 10/1988 Seegmiller ..... 405/288
4,960,348 A * 10/1990 Seegmiller ..... 405/288
5,018,907 A * 5/1991 Chugh et al. ..... 405/302.1
5,193,940 A * 3/1993 Long ..... 405/288
5,755,535 A * 5/1998 Fox ..... 405/288

* cited by examiner

*Primary Examiner*—Frederick L. Lagman
(74) *Attorney, Agent, or Firm*—Herbert Dubno; Andrew Wilford

(57) ABSTRACT

A truss has a pair of parallel and longitudinally extending chord rods and transverse rods interconnecting the chord rods. First and second slides each have a pair of tubes each fitting over a respective one of the chord rods and slidable longitudinally therealong and a cross member rigidly interconnecting the tubes and formed with a throughgoing hole through which passes a respective anchor member projecting from a tunnel or mine wall. The slides can be longitudinally fixed on the rods.

12 Claims, 5 Drawing Sheets

MINE ROOF-SUPPORT TRUSS

FIELD OF THE INVENTION

The present invention relates to a truss. More particularly this invention concerns a truss particularly designed to support a roof of a mine.

BACKGROUND OF THE INVENTION

In the mining industry and in the construction of tunnels, it is common practice to utilize a support that is composed of sections and backfilled with concrete. This concrete backfill is normally reinforced with the aid of lattice trusses or girders and anchored in the rock by rock bolts. The lattice girders are usually in the form of triangular-section girders. Regardless of girder shape, tunnels or drifts can have an arc-shaped cross section or a rectangular cross section. Mine or tunnel roof supports of rectangular cross section consist of a frame with a lintel and posts of wood or steel, wherein the lintel being subject to significant bending stresses.

OBJECTS OF THE INVENTION

It is therefore an object of the present invention to provide an improved truss for use as a mine or tunnel roof support.

Another object is the provision of such an improved truss for use as a mine or tunnel roof support which overcomes the above-given disadvantages, that is which is of simple construction, is very strong, and is readily combinable with the associated support structure.

SUMMARY OF THE INVENTION

A truss has according to the invention a pair of parallel and longitudinally extending chord rods and transverse rods interconnecting the chord rods. First and second slides each have a pair of tubes each fitting over a respective one of the chord rods and slidable longitudinally therealong and a cross member rigidly interconnecting the tubes and formed with a throughgoing hole through which passes a respective anchor member projecting from a tunnel or mine wall. The slides can be longitudinally fixed on the rods.

The truss according to the invention can be used as a support in tunnels or mines of rectangular cross section and consequently as a support frame in tunnels or mines with an arc-shaped cross section, namely in the form of a partial support on the periphery and/or in the longitudinal direction of the tunnel or mine. It is preferably utilized in holding up the roof. In addition, the truss according to the invention is also suitable for preventing rock slides in mountainous regions, on embankments or in the construction of roads. The anchor slides on its ends make it possible to adapt the truss according to the invention to already set rock bolts and fit to whatever the spacing between the bolts. If several anchor slides are provided over the length of the chords, such a truss can also be anchored at almost any location along its length. The ends of the truss according to the invention are placed on already set rock bolts in the region of the anchoring slides and locked in place with anchor nuts. Once the anchor nuts are screwed along the chord rods against the anchor-slide tubes, tensile forces are generated in the chords to create a polygon-like stress similar to an equilibrium polygon results. If required, additional rock bolts can be set about equidistantly over the length of the chords between the end anchors that, in case of a drift set support, are functionally set at an angle referred to the longitudinal axis of the truss according to the invention.

Consequently, the truss according to the invention also fulfills a hammock-like support function.

The chord rods are threaded and the slides are fixed on the chord rods by are nuts threaded onto the chord rods. This allows a simple and precise adaptation to already set rock bolts and consequently a flawless alignment of the truss. A third such slide can be provided in accordance with the invention on the chord rods between the first and second slides to allow anchoring of the truss at a midpoint or midpoints when three or four such slides are used.

The support truss further has according to the invention a coupling for joining two such trusses aligned longitudinally. The coupling has a central support member having a pair of parallel edges and four coupling tubes mounted on the support member. Two of the coupling tubes aligned longitudinally with each other and spaced longitudinally from each other on each of the support-member edges. The coupling tubes are transversely spaced to fit over the ends of the rods of the trusses, and a respective nut is threaded to each of the chord rods and bears longitudinally on each of the coupling tubes. Such a coupling is used by slipping two of its tubes over the ends of the chord rods of one truss, then installing two nuts on this one truss to prevent it from slipping back off. Then the chord rods of another truss are inserted into the other two tubes and two more nuts are installed. For the coupling to resist tension, one need merely install four nuts, two on each truss, in the center space between the two pairs of coupling tubes. For a compression-resistant coupling, four more nuts are installed outside the coupling. Several parallel trusses of identical or different lengths can be non-positively connected to one another in this fashion.

The central support member of the coupling is formed according to the invention with a throughgoing hole adapted to accommodate an anchor member so they can be used as anchoring plates to be connected to rock bolts.

The central support member can be a flat plate, or it can be formed by a pair of nonstraight rods each having a central section transversely engaging and fixed, e.g. by welding, to the central section of the other nonstraight rod and an outer end portion offset transversely outwardly from the respective central section and carrying one of the respective coupling tubes. When the support member is formed by welded nonstraight rods, the system is made very stable when a pair of transverse bridge elements is fixed between and extends transversely between the offset outer end portions of the nonstraight rods. The bridge elements and outer end portions thus form transversely throughgoing holes adapted to accommodate the anchor members.

It is also with in the scope of the invention to interconnect three parallel trusses to form a triangular truss, four parallel trusses to form a square-section truss and a series of parallel trusses that form a polygonal-section truss.

The coupling and/or the truss can be of steel or of reinforced plastic. When made of plastic, for instance with carbon or glass fiber reinforcement, the system can be imbedded in a face and, when the face is cut in a recovery operation the truss is simply ground up by the cutter with no damage to it and the bits of plastic are easily separated from the material, e.g. coal, at a later washing phase.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
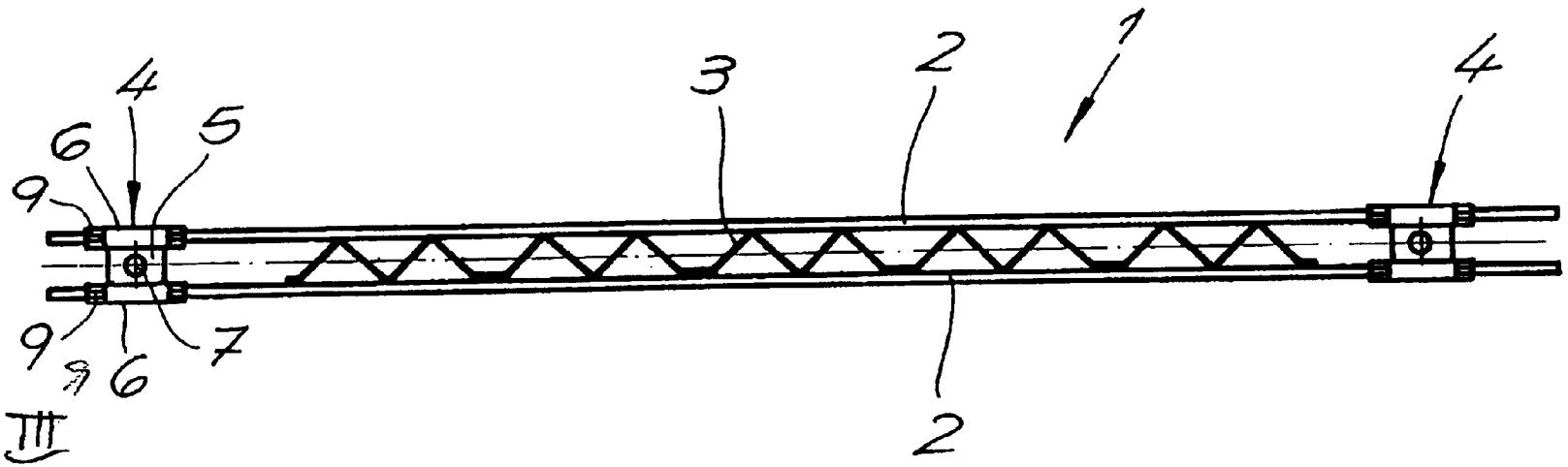
FIG. 1 is a small-scale top view of a support truss according to the invention.

As seen in FIGS. 1 through 4, a truss 1, in particular, for mining and tunnel supports comprises two parallel chords 2 and crossbars 3, e.g., diagonal rods, that connect the chords 2. Anchor slides 4 provided at least in the end regions of the truss 1 each comprise an anchor plate 5 with tubes 6 arranged on both edges. The anchor plates 5 are each formed with at least one throughgoing opening 7 or hole for a rock bolt 8.

Figure 2:
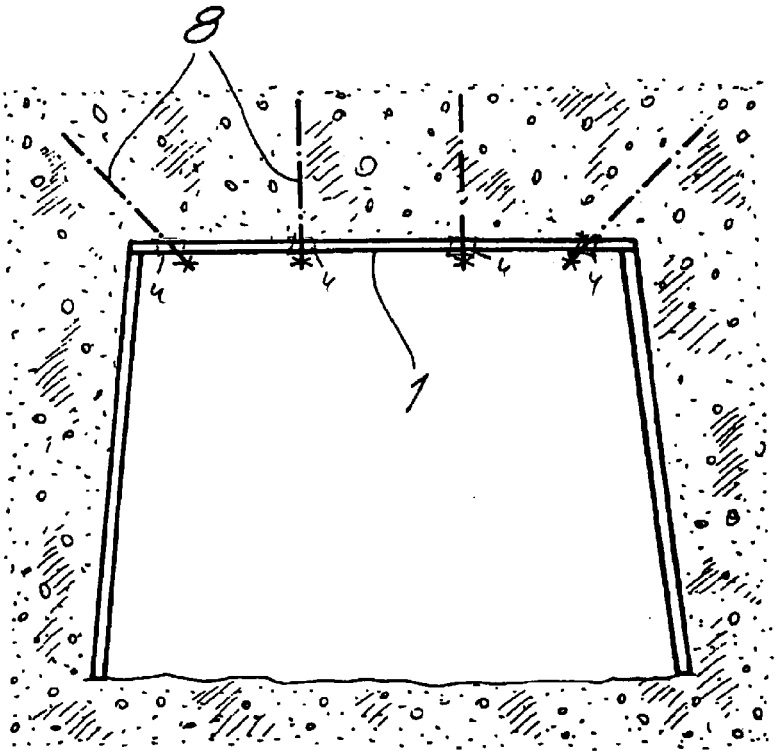
FIG. 2 is a largely schematic small-scale vertical section through a mine or tunnel with trusses according to the invention.
Figure 3:
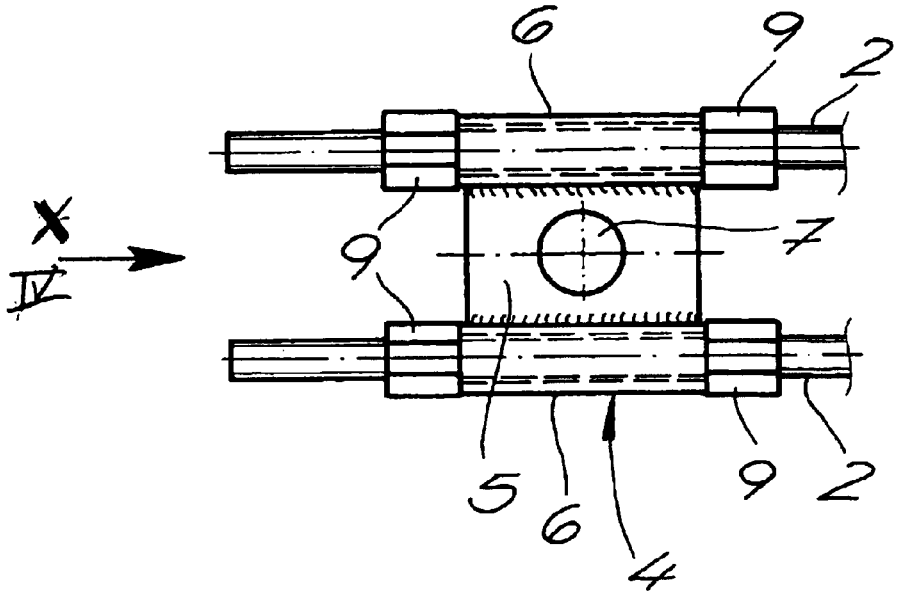
FIG. 3 is a large-scale view of the detail indicated at III in FIG. 1.
Figure 4:
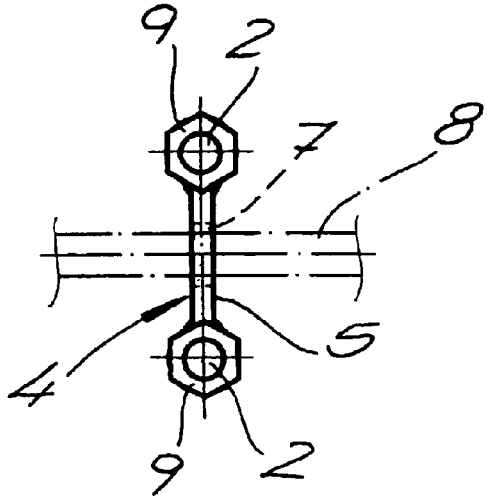
FIG. 4 is an end view taken in the direction of arrow IV of FIG. 3.

The tubes 6 are slid onto the chords 2 and can be fixed thereon in the aligned position of the slide. The chords 2 are threaded rods. The anchor slides 4 are fixed longitudinally on them by nuts 9 at one or both ends of the tubes 6. Several anchor slides 4 may be provided over the length of the chords 2 as illustrated in FIG. 2.

Figure 5:
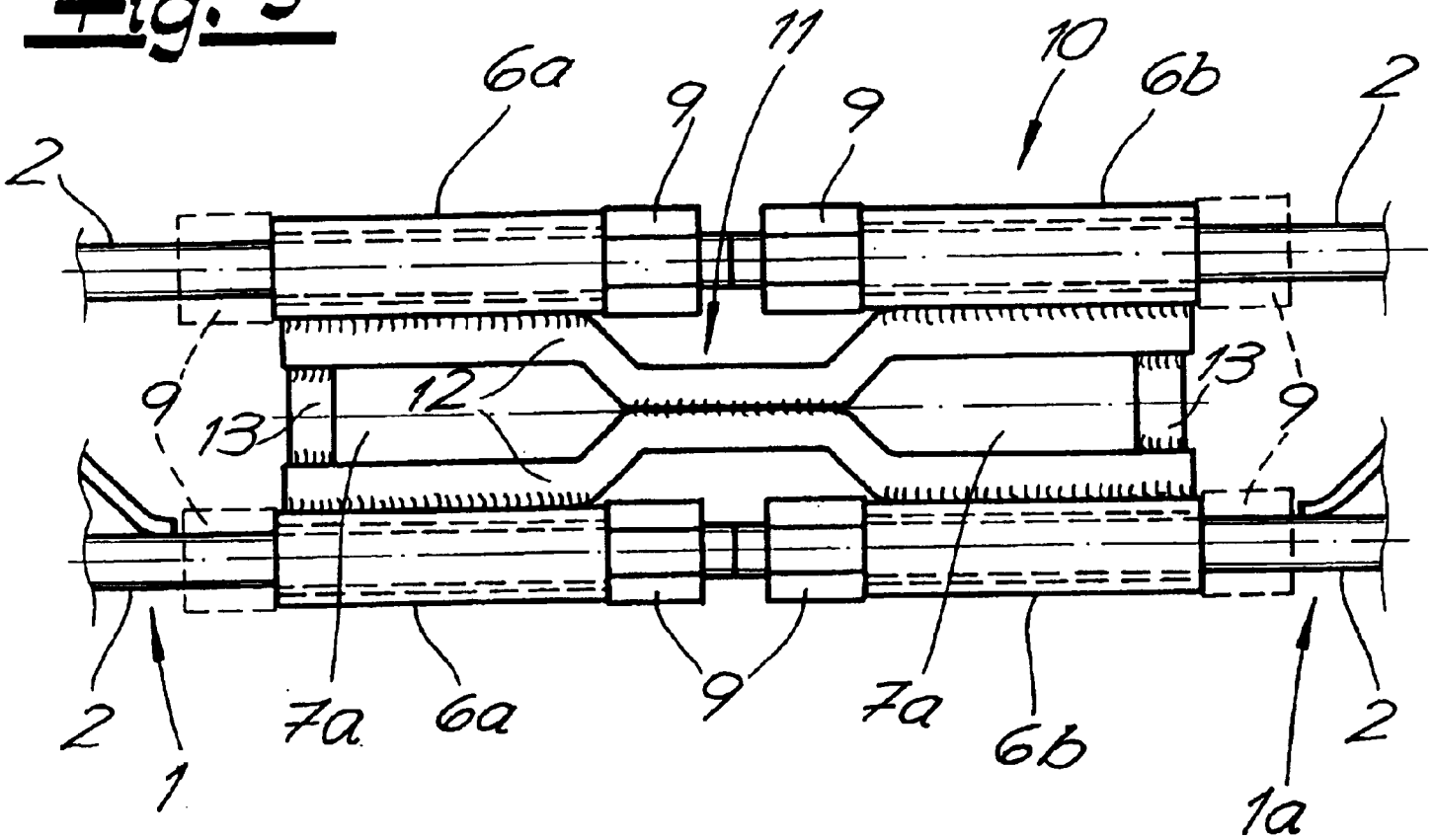
FIG. 5 is a view like FIG. 3 of a coupling according to the invention.

FIG. 5 shows a coupling 10 for longitudinally joining two identical trusses truss 1 and 1*a*. A first embodiment of this coupling 10 has two offset connecting rods 12 that are welded to one another at least in the region of a center offset 11. Four tubes 6*a* and 6*b* are mounted in pairs on the outer ends of the connecting rods 12 in their non-offset regions. Two aligned tubes 6*a*, 6*b* on each connecting rod 12 are spaced apart from one another by a predetermined longitudinal distance in order to allow nuts 9 to be fitted between them to the threaded chord rods 2 of the trusses 1 and 1*a*. One pair of tubes 6*a* is slid onto the chord rods 2 of one truss 1 and the other pair of tubes 6*b* is slid onto the chord rods 2 of the other truss 1*a*, producing a tension-resistant and, if required, compression-resistant connection in the aligned position by means of nuts 9 that are screwed on the chords 2 at one or both ends of the tubes 6. A tension-resistant connection is illustrated in the FIG. 5, the compression-resistant connection being formed by nuts 9 shown in broken lines. The two connecting rods 12 are welded to one another on their non-offset rod ends by means of stabilizing webs 13. In this manner, openings 7*a* for rock bolts 8 are formed between the non-offset outer rod ends.

Figure 6:
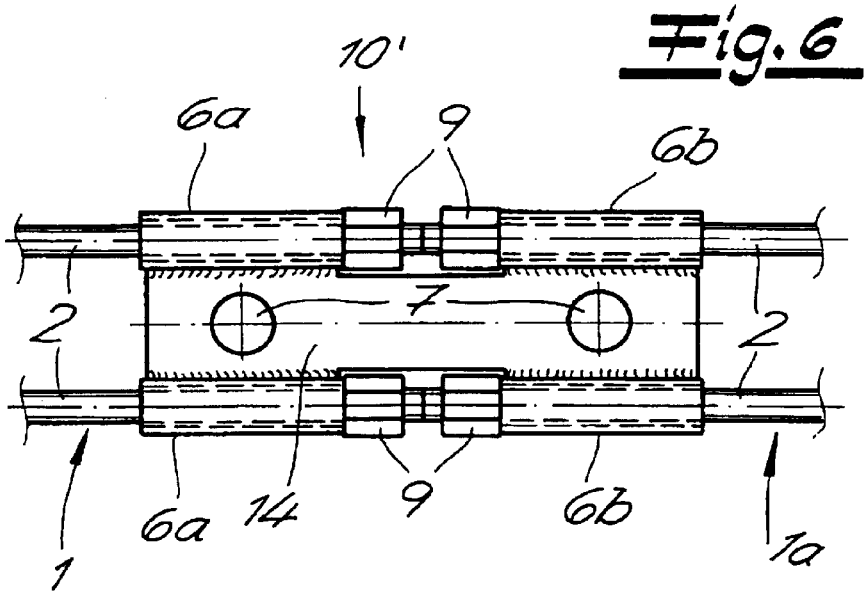
FIG. 6 is a view like FIG. 5 of a variation of the coupling of FIG. 5.
Figure 7:
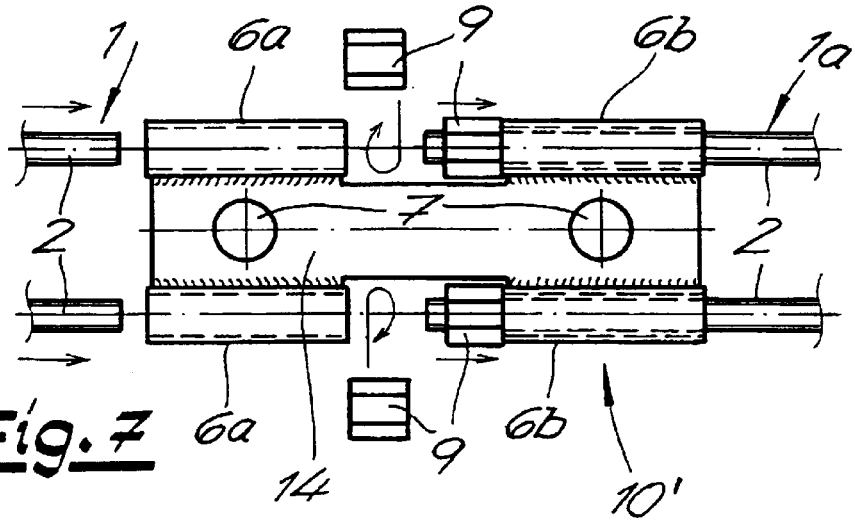
FIG. 7 is a view like FIG. 5 illustrating assembly of the FIG. 5 coupling.

In another embodiment shown in FIGS. 6 and 7, the coupling 10' comprises a butt plate 14 and four tubes 6*a*, 6*b* that are mounted in pairs on both longitudinal edges of the butt plate 14, with two aligned tubes 6*a*, 6*b* on each edge spaced apart from one another by a predetermined distance in order to accommodate the nuts 9. In this case, one pair of tubes 6*a* can also be slide onto the chords 2 of one parallel truss 1 and the other pair of tubes 6*b* can be pushed on the chords 2 of the parallel truss 1*a* to connect them longitudinally together. In the aligned position, a connection between the chords 2 and the pairs of tubes 6*a*, 6*b* of the coupling 10 can be produced by means of nuts 9 that are screwed onto the chords 2 at one or both ends of the tubes 6. The butt plate 14 is formed with one or more openings 7 so that it can be used as an anchor plate. The parallel truss 1 and the coupling 10 may consist of steel or plastic.

We claim:

1. In combination with a mine or tunnel wall from which project at least two anchor members, a truss comprising:

a pair of parallel and longitudinally extending chord rods;

transverse rods interconnecting the chord rods;

first and second slides each having a pair of tubes each fitting over a respective one of the chord rods and slidable longitudinally therealong, and a cross member rigidly interconnecting the tubes and formed with a throughgoing hole through which passes a respective one of the anchor members; and means for longitudinally fixing the slides on the rods.

2. The support truss defined in claim 1 wherein the chord rods are threaded and the fixing means are nuts threaded on the chord rods.

3. The support truss defined in claim 1 wherein a third such slide is provided on the chord rods between the first and second slides.

4. The support truss defined in claim 1, further comprising a coupling for joining two such trusses aligned longitudinally, the coupling comprising a central support member having a pair of parallel edges;

four coupling tubes mounted on the support member, two of the coupling tubes aligned longitudinally with each other and spaced longitudinally from each other on each of the support-member edges, the coupling tubes being transversely spaced to fit over the ends of the rods of the trusses; and a respective nut threaded to each of the rods and bearing longitudinally on each of the coupling tubes.

5. The support truss defined in claim 4 wherein the central support member of the coupling is formed with a throughgoing hole adapted to accommodate an anchor member.

6. The support truss defined in claim 4 wherein the central support member is a flat plate.

7. The support truss defined in claim 4 wherein the central support member is formed by a pair of nonstraight rods each having a central section transversely engaging and fixed to the central section of the other nonstraight rod and an outer end portion offset transversely outwardly from the respective central section and carrying one of the respective coupling tubes.

8. The support truss defined in claim 7, further comprising a pair of transverse bridge elements fixed between and extending transversely between the offset outer end portions of the nonstraight rods, the bridge elements and outer end portions forming transversely throughgoing holes adapted to accommodate the anchor members.

9. The support truss defined in claim 4 wherein the coupling is of steel.

10. The support truss defined in claim 4 wherein the coupling is of reinforced plastic.

11. The support truss defined in claim 1 wherein the chord rods and transverse rods are of steel.

12. The support truss defined in claim 1 wherein the chord rods and transverse rods are of reinforced plastic.

* * * * *